313-422 SR
10/10/78 XR 4,119,882

United States Patent [19]
Chin

[11] 4,119,882
[45] Oct. 10, 1978

[54] CATHODE FOR FLAT PANEL DISPLAY

[75] Inventor: Te Ning Chin, Princeton, N.J.

[73] Assignee: RCA Corporation, New York, N.Y.

[21] Appl. No.: 770,510

[22] Filed: Feb. 22, 1977

[51] Int. Cl.[2] ..... H01J 1/94; H01J 29/04
[52] U.S. Cl. ..... 313/411; 313/258; 313/270; 313/422; 313/482
[58] Field of Search ..... 313/411, 422, 495, 270, 313/482, 258

[56] References Cited

U.S. PATENT DOCUMENTS

| | | | |
|---|---|---|---|
| 2,686,272 | 8/1954 | Rogers et al. | 313/270 X |
| 2,758,234 | 8/1956 | Hensel | 313/411 |
| 2,858,464 | 10/1958 | Roberts | 313/411 |
| 3,086,136 | 4/1963 | Almer et al. | 313/258 X |

*Primary Examiner*—Palmer C. Demeo
*Attorney, Agent, or Firm*—E. M. Whitacre; G. H. Bruestle; D. H. Irlbeck

[57] ABSTRACT

An evacuated envelope includes front and back walls and a plurality of spaced, parallel support walls between and perpendicular thereto. The support walls form therebetween a plurality of channels. In each of the channels is at least one beam guide which confines electrons injected into the guide in a beam which travels along the beam guide but permits selective deflection of the beam out of the guide toward a phosphor screen on the inner surface of the front wall. A gun structure extends across one end of the channels for generating electrons and directing the electrons into the beam guides. The gun structure includes a thermionic emissive cathode extending across the ends of the channels and support members at spaced points along the cathode which support the cathode within the envelope but allow movement of the cathode with respect to the support members as a result of expansion or contraction of the cathode.

7 Claims, 4 Drawing Figures

CATHODE FOR FLAT PANEL DISPLAY

BACKGROUND OF THE INVENTION

The present invention relates to a cathode for a flat panel display device, and particularly to a thermionic emissive line cathode for such a display device.

There has been developed a cathodoluminescent flat panel display which includes an evacuated envelope having substantially flat front and back walls secured together in spaced, substantially parallel relation by side walls. A plurality of spaced, parallel support walls extend between the front and back walls and divide the envelope into a plurality of channels which extend along the front and back walls between a pair of opposed side walls. In each of the channels is at least one electron beam focusing guide which is adapted to guide a beam of electrons along the channel and yet allow the beam to be deflected toward the front wall at selected points along the channel. By the expression "guiding" the beam along the channel, it is meant that the focusing guide confines the electrons in a beam as the beam travels along the channel. On the front wall of the envelope is a phosphor screen which is impinged upon when the beam of electrons is deflected out of its guide. Along one end of the channels is a gun section which contains an electron gun structure. The gun structure generates electrons and directs the electrons as beams into the beam guides.

Various gun structures have been proposed for generating electrons and directing the electrons as beams along a plurality of parallel paths. Gun structures which include thermionic emissive line cathodes are shown in U.S. Pat. No. 2,858,464 to W. L. Roberts, issued Oct. 28, 1958, entitled "Cathode Ray Tube" and U.S. Pat. No. 3,531,681 to J. T. Harden, Jr., issued Sept. 29, 1970, entitled "Flat Display Tube and Method." However, in a large size flat panel display, i.e., a display which is about 100 cm by 75 cm, there are a number of problems in using such a line cathode.

SUMMARY OF THE INVENTION

In a display device, e.g., of the type described, means for generating the electrons includes a thermionic emissive line cathode having a plurality of supports at spaced points along and between the ends of the cathode. The supports permit relative movement between the line cathode and the supports.

DETAILED DESCRIPTION OF THE INVENTION

Figure 1:
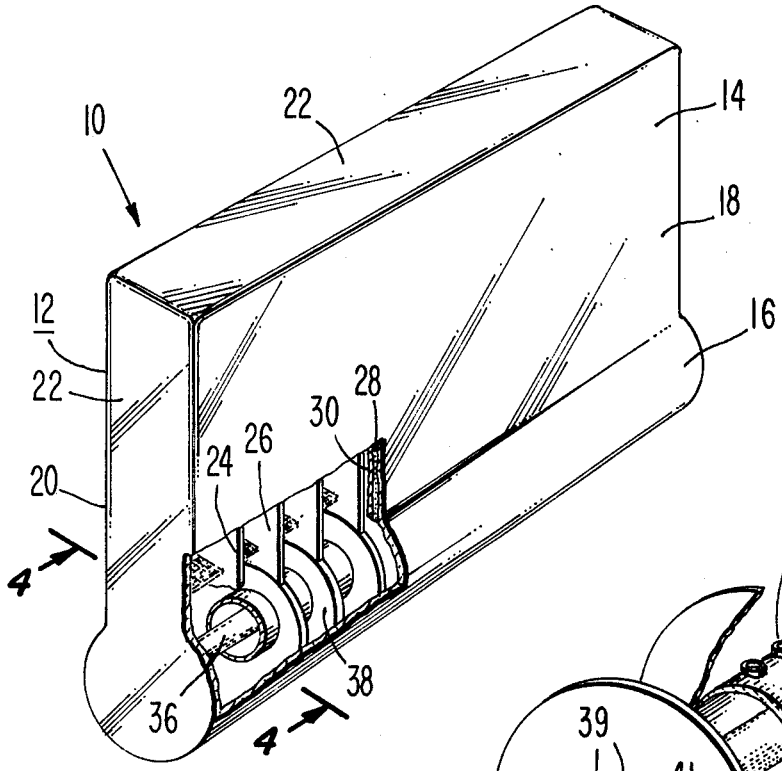
FIG. 1 is a perspective view, partially broken away of a form of a display device having the line cathode of the present invention.
Figure 2:
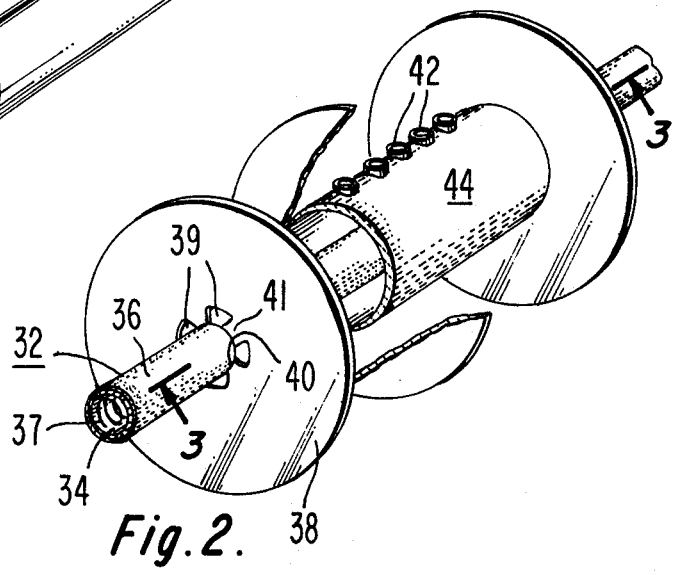
FIG. 2 is a perspective view, partially broken away of a portion of the cathode.
Figure 3:
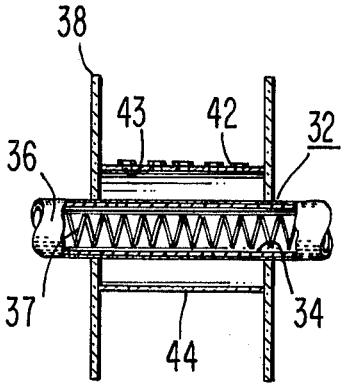
FIG. 3 is a sectional view taken along line 3—3 of FIG. 2.
Figure 4:
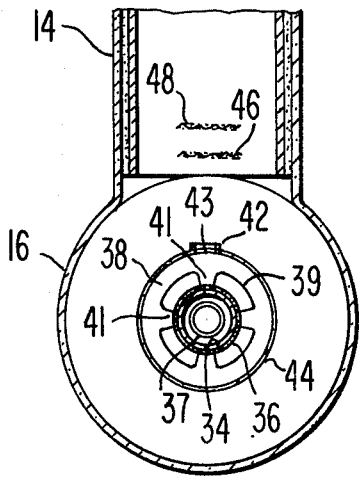
FIG. 4 is a sectional view of the display device taken along line 4—4 of FIG. 1.

Referring to FIG. 1 a form of a flat display device utilizing the cathode of the present invention is generally designated as 10. The display device 10 comprises an evacuated envelope 12, typically of glass, having a display section 14 and an electron gun section 16. The display section 14 includes a rectangular front wall 18 and a rectangular back wall 20 in spaced, parallel relation with the front wall 18. The front wall 18 and back wall 20 are connected by side walls 22. The front wall 18 and back wall 20 are dimensioned to provide the size of the viewing screen desired, e.g. 75 × 100 cm and are spaced apart about 2.5 to 7.5 cm.

A plurality of spaced, parallel support walls 24 are secured between and perpendicular to the front wall 18 and the back wall 20 and extend from the gun section 16 to the opposite side wall 22. The support walls 24 provide the desired internal support for the evacuated envelope 12 against external atmospheric pressure and divide the display section 14 into a plurality of channels 26. On the inner surface of the front wall 18 is a phosphor screen 28. The phosphor screen 28 may be of any well known type presently being used in cathode ray tubes, e.g., black and white or color television display tubes. A metal film electrode 30 is provided on the phosphor screen 28.

In each of the channels 26 is one or more focusing guides for confining electrons directed into the channel into a beam which travels a path along the channel. Each guide also includes means for deflecting its beam out of the guide and toward the phosphor screen 28 at various points along the length of the channel 26. One type of focusing guide which can be used is described in the co-pending application for U.S. Patent of T. L. Credelle, Ser. No. 607,490, filed Aug. 25, 1975 entitled "Flat Display Device With Beam Guide", now U.S. Pat. No. 4,103,204. Alternatively, another type of focusing guide which can be used is described in the co-pending application for U.S. Patent of W. W. Siekanowicz et al, Ser. No. 671,358, filed Mar. 29, 1976, entitled "Flat Display Device With Beam Guide", now U.S. Pat. No. 4,088,920.

The gun section 16 is an extension of the display section 14 and extends along one set of adjacent ends of the channels 26. The gun section 16 is of a shape suitable to enclose the gun structure contained therein. The gun structure includes a line cathode, generally designated as 32. As shown, the line cathode 32 is preferably of the indirectly heated theremionic type which comprises an elongated cylindrical tube 34 of a thermally and electrically conductive material having a thin coating 36 of an electron emissive material on its outer surface. The electron emissive coating 36 may be of any of the well known electron emissive materials, such as the oxides of barium, strontium, calcium or mixtures thereof. Within the tube 34 is a resistive heater 37.

The line cathode 32 extends through and is supported on a plurality of support discs 38 which are positioned in spaced relation along and between the ends of the line cathode 32. The support discs 38 are of a material which will withstand the temperature of the line cathode 32 and which is thermally and electrically insulating, such as mica or boron nitride. The support discs 38 are positioned at, and in alignment with, the support walls 24 so that they do not interfere with the directing of electrons into the channels 26. Although there is shown a separate support disc 38 at each of the support walls 24, there may be fewer support discs than support walls 24, depending on the spacing between the support walls 24. Although the support discs 38 are shown as being circular, they can be rectangular or any other shape which will fit rigidly in the gun section 16. The line cathode 32 is supported in the support discs 38 so as to permit relative movement between the line cathode and the support discs as a result of expansion or contraction of the line cathode. Each of the support discs 38 has a plurality of circumferentially spaced notches 39 extending radially outwardly from an opening 40 in the center of the disc to provide a plurality of circumferentially spaced fingers 41. The line cathode 32 passes through the openings 40 and is supported by the fingers 41. One of the notches 39 is positioned along the portion of the electron emitting layer 36 which faces toward the channels 26 so that the electron emitting layer is not scraped from the tube 34 when the tube expands and contracts. The ends of the cathode tube 34 are preferably supported from the gun section 16 by springs (not shown) which mechanically support the line cathode tube 34 but will allow for expansion and contraction of the tube.

Between the line cathode 32 and the ends of the channels 26 are a plurality of spaced electron emission control grids 42. As shown, the control grids 42 are metal films around individual openings 43 in a grid supporting tube 44 of an electrical insulating material. The grid supporting tube 44 is mounted between two adjacent cathode support discs 38 in spaced concentric relation to the line cathode 32. The openings 43 are positioned in alignment with the ends of the focusing guides in the channels 26 of the display section 14.

An acceleration grid 46 extends along the line cathode 32 between the control grids 42 and the ends of the channels 26; and a focusing grid 48 extends along the line cathode 32 between the acceleration grid 46 and the ends of the channels. The acceleration grid 46 and focusing grid 48 each may be a wire mesh or a metal plate having holes therethrough in alignment with the holes 43 in the grid support tube 44.

In the operation of the display device 10, the resistive heater 37 is turned on to heat up the electron emissive material layer 36 so that electrons are emitted from the cathode 32. A potential is applied to the acceleration grid 46 so that it is positive with respect to the cathode 32. This causes the electrons to flow from the cathode 32 toward the accelerating grid 46. The electrons pass through the openings 43 in the grid supporting tube 44 so as to form the electrons into a plurality of beams, each of which will pass into a separate focusing guide in the channels 26. By applying the appropriate potentials to the control grids 42 the individual beams of electrons can be modulated. As described in each of the copending applications Ser. No. 607,490 and Ser. No. 671,358, the beams passing along the focusing guides in the channels 26 are selectively deflected toward the phosphor screen 28 at various points along the channels to achieve a line-by-line scan of the phosphor screen 28 and thereby achieve a display on the phosphor screen.

When the cathode tube 34 is heated, there is a tendency for the tube to sag, particularly if the tube is long as in the display device of the present invention. Such a sagging of the cathode tube 34 would result in a non-uniform spacing between the cathode and the focusing guides along the length of the cathode which in turn would result in a non-uniformity of the electron beams. However, in the gun structure of the present invention the cathode tube 34 is supported at spaced points along its length by the support discs 38 so as to prevent sagging of the cathode tube. Even though the cathode tube 34 is supported, the cathode tube is movable with respect to the support discs 38 upon expansion or contraction of the cathode tube so that the cathode tube 34 is not stressed. Also, the portion of the electron emissive layer which faces the focusing guides does not contact the support discs 38 so that such electron emissive material will not be scraped from the cathode tube 34 upon movement of the tube with respect to the support discs. Thus, there will always be electron emissive material from which electrons can be emitted facing the focusing guides even if the support tube moves. In addition the thermal loss from the cathode 32 is minimized by making the support discs 38 of a material which does not have good heat conduction and by minimizing the contact between the discs 38 and the line cathode. This improves the thermal efficiency of the cathode. Thus, the support discs 38 provide rugged support for the cathode without adversely affecting the thermal efficiency of the cathode.

I claim:

1. In a display device having an evacuated envelope which includes substantially rectangular front and back walls secured together in spaced relation by side walls, support walls in the envelope between the front and back walls, a phosphor screen on the inner surface of the front wall and means along one of the side walls for generating electrons and directing the electrons as a plurality of beams across the front wall, said means including a thermionic emissive line cathode extending horizontally along one of said side walls, said support walls extending in spaced, parallel relation between the line cathode and the opposite side wall to provide a plurality of parallel channels, the improvement comprising, said line cathode at least partially being supported by a plurality of supports at spaced points along and between the ends of said line cathode, said supports being rigid in a direction transverse to said line cathode but allowing relative movement between said line cathode and said supports in the longitudinal direction of said line cathode and wherein said supports are each positioned at separate ones of said support walls.

2. A display device in accordance with claim 1 in which each of said cathode supports is a disc of an electrical insulating material.

3. A display device in accordance with claim 2 in which the cathode includes an elongated metal member coated with a layer of an electron emissive material.

4. A display device in accordance with claim 3 in which the elongated metal member of the cathode is tubular and a resistive heater is within the tubular metal member.

5. A display device in accordance with claim 4 in which the metal member of the cathode extends through openings in the support discs and the edges of the openings are spaced from the portions of the electron emissive material which faces the channels.

6. A display device in accordance with claim 5 in which each of the support discs has a plurality of circumferentially spaced notches extending radially outwardly from the opening therethrough with one of said notches being positioned along the portion of the electron emissive material which faces the channels.

7. A display device in accordance with claim 6 including grid means between the line cathode and the channels for drawing electrons from the cathode in the form of a plurality of beams and controlling the flow of said electrons to the channels.

* * * * *